United States Patent [19]

Brendle et al.

[11] 4,110,722

[45] Aug. 29, 1978

[54] VARIABLE RESISTANCE CONTROL

[75] Inventors: Paul C. Brendle, Streetsville; Brian B. Clarkson, Brampton, both of Canada

[73] Assignee: CTS Corporation, Elkhart, Ind.

[21] Appl. No.: 816,314

[22] Filed: Jul. 18, 1977

[51] Int. Cl.[2] ..... H01C 10/34

[52] U.S. Cl. ..... 338/174; 338/163; 338/164; 338/184; 338/199

[58] Field of Search ..... 338/174, 162, 163, 164, 338/184, 199

[56] References Cited

U.S. PATENT DOCUMENTS

| | | | |
|---|---|---|---|
| 3,227,985 | 1/1966 | Hardison et al. | 338/162 |
| 3,947,800 | 3/1976 | Van Benthuysen et al. | 338/163 |
| 3,982,220 | 9/1976 | Rozema et al. | 338/174 |

*Primary Examiner*—C. L. Albritton
*Attorney, Agent, or Firm*—John J. Gaydos

[57] ABSTRACT

A variable resistance control having a clutch to prevent overdriving of a contactor relative to a resistance element. A driving member is rotatably and coaxially secured to a driven member in fixed relationship with the contactor. Knurled clutch faces formed on the driving member and the driven member are configured to permit sliding movement between the clutch faces when the driven member has reached its limit of travel and rotation of the driving member is continued.

10 Claims, 5 Drawing Figures

VARIABLE RESISTANCE CONTROL

The present invention relates to variable resistance controls and, more particularly, to a variable resistance control having a clutch.

Variable resistance controls generally are provided with a stop mechanism for limiting or halting travel of a movable contactor beyond predetermined limits, i.e., the ends of a resistance element. A driving member of the variable resistance control, such as a shaft or knob, operably coupled or secured to the contactor when rotated by an operator moves the contactor along the resistance element intermediate the ends thereof. Continued rotation of the driving member after the stop mechanism halts rotation of the contactor could result in damage to the internal structure of the control, such as bending of the stop mechanism thereby altering the limits of the control. In response to customer preference that the variable resistance controls be miniaturized, difficulties have been encountered in maintaining mechanical strength of the parts employed in the controls. The problem encountered in producing a part such as a stop mechanism of sufficient strength to withstand the force applied to the driving member are commonly known since, as size of a control is arithmetically reduced, the structural strength of each of the parts is usually reduced, exponentially. It would, therefore, be desirable to provide a variable resistance control with a clutch having a minimum number of parts.

The prior art is replete with variable resistance controls having clutches for disengaging the contactor from the driving member of a control when rotation of the contactor is halted and continued force is applied to the driving member. Generally such clutches utilize a mechanical flexing or racheting device between the driving and driven members, for example, see Grunwald et al. U.S. Pat. No. 3,242,452 and Van Benthuysen et al. U.S. Pat. No. 3,416,119 describing variable resistance controls having a clutch employing mechanical movement or flexing of a part of a gear segment for disengaging the driving member from the driven member. Incorporating a clutch into a control generally increases the number of parts between a driving and a driven means of the control thereby increasing the cost of the control. It would, therefore, be desirable to eliminate the additional part or parts interposed between the driving and driven means and still convey to the operator a signal such as a clicking noise when slipping action occurs.

Accordingly, it is an object of the present invention to provide a variable resistance control with a clutch. An additional object of the present invention is to provide a variable resistance control with a clutch having a minimum number of parts that can be readily assembled. Another object of the present invention is to provide a variable resistance control with a clutch by rotatably securing a driving member having a clutch face to the driven member or shaft of the control provided with a partially complementary clutch face. Still another object of the present invention is to provide a variable resistance control with a clutch wherein the faces of the clutch comprise knurled surfaces. Yet another object of the present invention is to provide a variable resistance control having a clutch producing an audible ratcheting or clicking action that enables the operator to sense that he has exceeded to rotational limits of the control. Further objects and advantages of the present invention will become apparent as the following description proceeds and the features of novelty characterizing the invention will be pointed out with particularity in the claims annexed to and forming a part of this specification.

Briefly, the present invention relates to a variable resistance control having a clutch comprising a driven member provided with a clutch face engaging a clutch face provided on a driving member rotatably secured to the driving member. A contactor constrained to rotate with the driven member wipably engages a resistance element intermediate the ends thereof. When the contactor reaches one of the ends of the resistance element, rotation of the driven member is halted by a stop arm engaging a stop member carried by the driven member. Further rotation of the driving member causes the engaging clutch face of the driving member to slide against the clutch face of the driven member. In a preferred embodiment of the present invention, the clutch faces comprise knurled surfaces and the crests of the knurls of the driving member are not only slideable over the crests of the knurls of the driven member but in addition the crests of both members are deformable.

For a better understanding of the present invention, reference may be had to the accompanying drawings wherein the same reference numerals have been applied to like parts and wherein.

Figure 1:
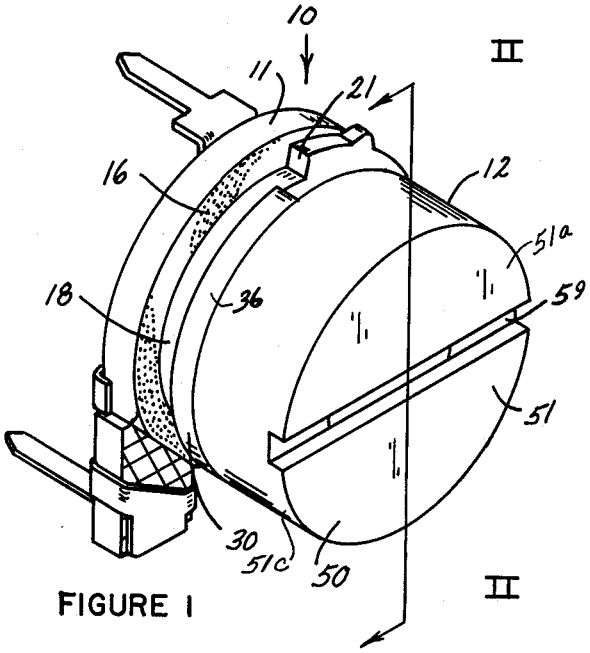
FIG. 1 is an isometric view of a variable resistance control built in accord with the present invention.
Figure 2:
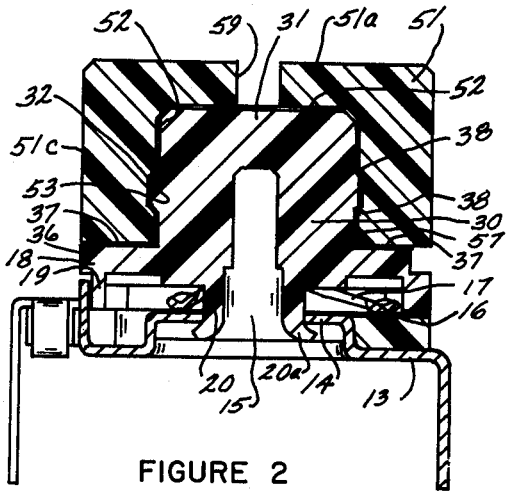
FIG. 2 is a sectional view taken generally along lines II—II of FIG. 1 showing the driven member in an interference fit with the clutch face of the driving member.
Figure 3:
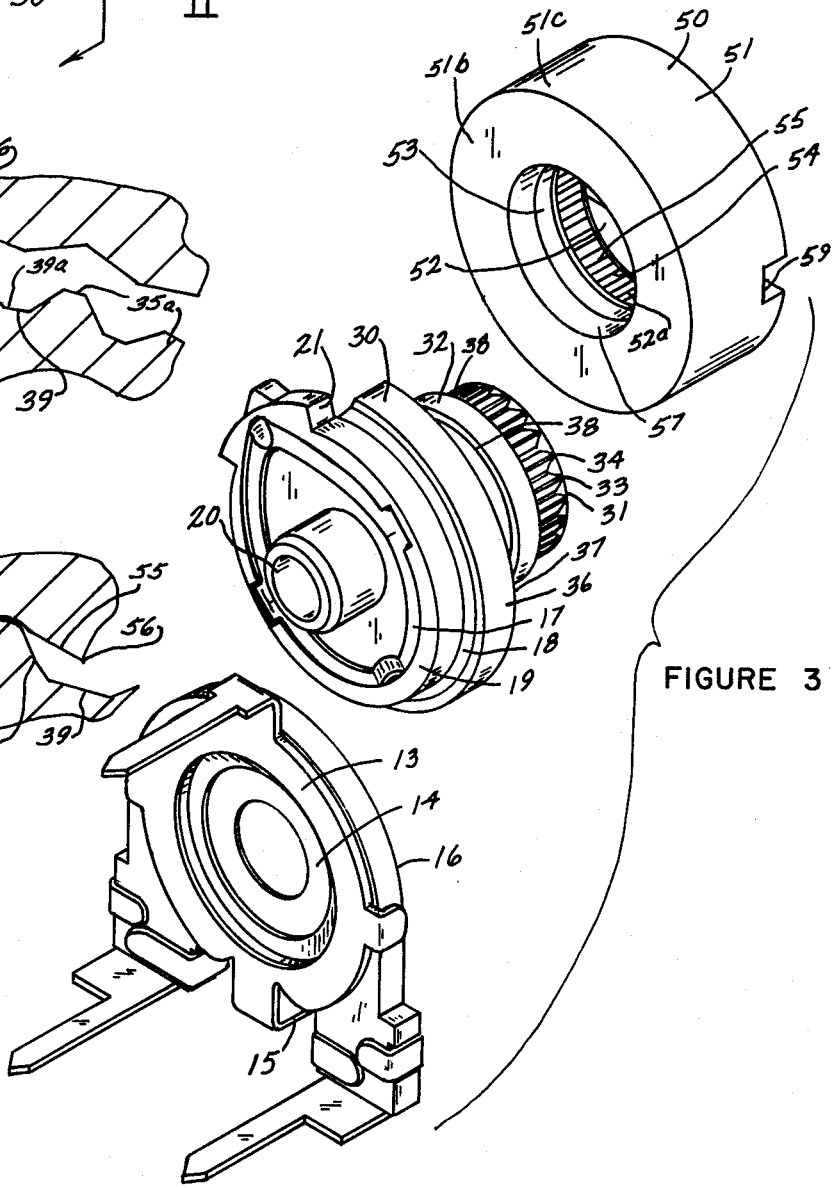
FIG. 3 is an exploded isometric view of the control of the present invention shown in FIG. 1.

Referring now to the drawings, there is illustrated a variable resistance control generally indicated at 10 comprising a variable resistance section 11 and a clutch 12. The variable resistance section as best shown in FIGS. 2 and 3, comprises a supporting plate 13 of conductive metal, e.g. brass, having an integral embossed collector 14 and a stop arm 15. A U-shaped resistance element 16 of suitable material such as carbon or cermet is mounted against the supporting plate 13. A contactor 17 constrained to rotate with a driver 18 wipably engages the resistance element 16 and the collector 14. The driver 18 is provided with a peripheral skirt 19 and a hollow shaft 20. The shaft 20 received in an opening 14a provided in the supporting plate 13 rotatably supports the driver 18. By flaring the end **20*a* (see FIG. 2) of the shaft 20 outwardly against the supporting plate 13, the parts are maintained in assembled relationship with the contactor 17 spring biased against the resistance element 16 and the collector 14. A stop member 21 (see FIG. 3) projects outwardly from the skirt 19 of the driver 18 and abuttingly engages the stop arm 15 of the supporting plate 13 as the limits of rotation of the driver 18 are reached thereby preventing further rotation of the driver 18 with respect to the supporting plate. The driver 18 also functions as an indicator and designates the angular location of the portion of the contactor engaging the resistance element. The variable resistance section 11** of the control is described in greater detail in U.S. Pat. No. 3,947,800 incorporated herein by reference.

The clutch 12 comprises a driven member 30 integrally formed with the driver 18 and a driving member 50. The driven member 30 and the driving member 50 are made of an electrically nonconductive heat swageable plastic having good cold flow resilient characteristics such as nylon. The driven member 30 is provided with a hub 31 coaxial with the shaft 20 and an annular ring 32 extending radially outwardly from the hub 31. In accord with the present invention, the surface of the hub 31 defines a clutch face 33 having a plurality of knurls 34 and crests 35 (see FIGS. 3 and 4). The driving member 50 comprises a cylindrical cap 51 having a top surface 51*a*, a bottom surface 51*b* and a cylindrical surface 51*c*. Extending inwardly of the bottom surface 51*b* is a circular opening 52 having an annular recess 53 disposed within the circular opening 52, the internal diameter of the circular opening 52 being smaller than the internal diameter of the recess 53. The inner wall 52*a* of the circular opening 52 is provided with a clutch face 54 having a plurality of knurls 55 and crests 56. The upper surface 37 of a support member 36 concentric and integrally formed with the hub 31 and the driver 18 abuttingly engages the bottom surface 51*b* of the driving member 50. Preferably, the annular ring 32 of the driven member 30 spaced from the support member 36 is provided with chamfered edges 38 to facilitate assembly with the annular recess 53 of the driving member 50. In a preferred form of the present invention and as shown in FIG. 2, the driving member 50 is rotatably mounted on the hub 31 with the annular ring 32 of the driven member 30 rotatably nested in the recess 53 and with the knurls 55 clutchably engaging the knurls 34. The driving member 50 and the driven member 30 are maintained in assembled relationship by making the ring with a slightly larger diameter than the inner diameter of the cylindrical opening 52 in the driving member 50. The driving member is also maintained in alignment with the driven member by the annular ring 32 being received in the annular recess 53.

Figure 4:
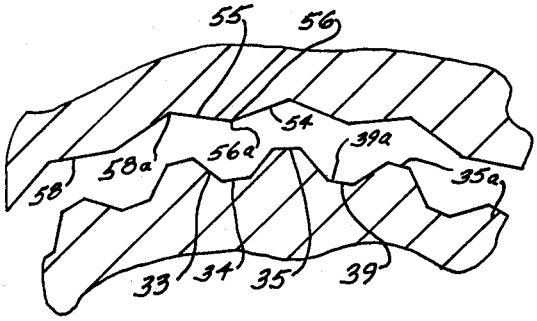
FIG. 4 is an enlarged fragmentary sectional view of the clutch faces of the driving member and the driven member, the clutch faces not being in engagement as shown in FIG. 3.
Figure 5:
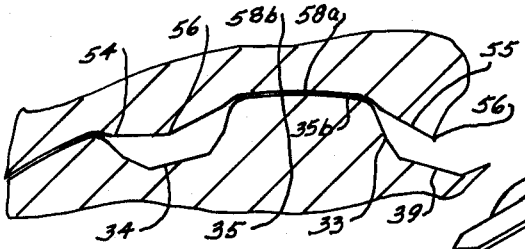
FIG. 5 is an enlarged fragmentary sectional view showing the clutch face of the driven member in an interference fit with the clutch face of the driving member.

As best shown in FIG. 4 of the drawings, the crests 35 on the hub 31 on the driver member 30 are each provided with a flat surface 35*a* while the valleys 39 are also each provided with a flat surface 39*a*. Preferably, and in accord with the present invention, the crests 56 in the cylindrical opening 52 of the driving member 50 are defined by a sharp edge 56*a* while the valleys 58 are also defined by a groove 58*a*. While the driven member 30 and the driving member 50 are each provided with an equal number of knurls, the flats 35*a* diametrically opposed form an interference fit with the internal diameter across the valleys provided in the driving member 50 and satisfactory results have been obtained by making such diameters in an interference fit of approximately 0.004 inches. Since there is an interference fit of 0.002 inches between the flat 35*a* of the crest 35 and the bottom of the valleys 58*a*, slight deformation of the crests and the valleys occurs during assembly and snapping of the driving member 50 over the hub 31 of the driven member 30. Such deformation is shown in the enlarged fragmentary sectional view (see FIG. 5) showing the bottom of the valley 58*a* flattened and adjacent to flattened portion 35*b* of crest 35. During rotation of the driven member, as one of the crests 56 of the knurls 55 slides from one of the valleys 39 to the adjacent valley 39 of the knurls 34 and engage adjacent the crest 35, mutual resilient deformation of the knurls 55 and the crests 35 occurs until the adjacent valley 39 is reached. Additionally, as the crests 56 slide over the driven crests 35, the radial forces generated in the driven member 30 and in the driving member 50 are symmetrical about the axis of rotation as the points of engagement of the clutch faces 33 and 54 are uniformly distributed about each circumference. A screw driver slot 59 is provided in the driving member 50 to facilitate rotation thereof. Continued rotation of the driving member 50 causes the engaging crests 56 to slide resiliently over the crests 35 of the driven member 30 only when rotation of the driver 18 and the driven member 30 integral therewith is stopped by engagement of the stop member 21 with the stop arm 15 thereby providing a slip clutch for the control 10. Otherwise the driving and driven members 50 and 30 rotate as a unit.

While there has been illustrated and described what is at present considered to be a preferred embodiment of the present invention it will be appreciated that numerous changes and modifications are likely to occur to those skilled in the art, and it is intended in the appended claims to cover all those changes and modifications which fall within the true spirit and scope of the present invention.

What is claimed as new and desired to be secured by Letters Patent of the United States is:

1. A variable resistance control comprising a resistance element and a collector, a contactor wipably engaging the collector and the resistance element intermediate the ends thereof, a driver constrained to rotate with the contactor, a first member integral with the driver and defined by an outwardly extending cylindrical coaxial hub, an annular ring disposed on the hub in spaced relationship to the driver and having a diameter larger than the diameter of the hub, a first clutch face defined by a plurality of axial knurls disposed about the periphery of the first member, a second member having an axially extending cylindrical bore, a second clutch face defined by a plurality of knurls disposed within the bore, the second member having an annular recess provided within the bore and having an inner diameter larger than the inner diameter of the bore, the hub being received within the bore, the first and second clutch faces clutchingly engaging each other, the annular ring nesting within the annular recess and rotatably interlocking the second member to the first member.

2. A variable resistance control, in combination comprising a resistance element, a contactor for making wiping contact with the resistance element intermediate the ends thereof, a driver constrained to rotate with the contactor, a first member constrained to rotate with the driver, a first clutch face disposed on the first member, a second member coaxial with the first member, a second clutch face disposed on the second member and clutchably engaging the clutch face of the first member and means resiliently interlocking and rotatably securing the first member to the second member in axial direction, one of the first member and the second member being provided with an axially extending bore, the other of the first member and the second member being received within the bore in telescopic relationship whereby upon continued rotation of the second member relative rotation between the clutch faces occurs when rotation of the first member is halted with the contactor being disposed at one of the ends of the resistance element.

3. The control of claim 2, wherein the clutch faces are axially disposed on the members and are in interference with each other.

4. The control of claim 3, wherein the bore is cylindrical, the second clutch face is disposed within the bore.

5. The control of claim 4, wherein the clutch faces each comprise a plurality of knurls whereby upon relative rotation between the clutch faces the crests of the knurls of one clutch face slide over the crests of the knurls of the other clutch face.

6. The control of claim 5, wherein the first member comprises a hub, the means interlocking the rotatably securing the members includes an annular ring on the hub, and an annular recess provided in the bore receives the ring.

7. The control of claim 6, wherein the diameter of the hub is less than the diameter of the bore, and the diameter of the annular ring is greater than the diameter of the bore and less than the diameter of the annular recess.

8. The control of claim 7, wherein the knurls of the two clutch faces interfere with each other.

9. The control of claim 2, wherein the means resiliently interlocking and rotatably securing the first member to the second member comprises an annular recess within the bore, and a complementary annular ring is disposed on the member received within the bore.

10. The control of claim 9, wherein an axial wall of the annular recess is of resilient material and telescopically fits over the annular ring thereby interlocking the two members together.

* * * * *